US012704340B2

(12) United States Patent
Dueck et al.

(10) Patent No.: US 12,704,340 B2
(45) Date of Patent: Aug. 11, 2026

(54) FIREARM SOUND SUPPRESSOR WITH PERIPHERAL VENTING

(71) Applicant: SureFire, LLC, Fountain Valley, CA (US)

(72) Inventors: Barry William Dueck, Fountain Valley, CA (US); Michael Standen, Fountain Valley, CA (US); Eric Hung Leung Chow, Fountain Valley, CA (US); Ryan Steven Glasby, Fountain Valley, CA (US); Douglas Lawrence Stefanski, Fountain Valley, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 17/681,246

(22) Filed: Feb. 25, 2022

(65) Prior Publication Data

US 2022/0276016 A1 Sep. 1, 2022

Related U.S. Application Data

(60) Provisional application No. 63/154,564, filed on Feb. 26, 2021.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 6,308,609 B1 * 10/2001 Davies ..... F41A 21/30 89/14.4
7,073,426 B1 * 7/2006 White ..... F41A 21/30 89/14.4
8,167,084 B1 * 5/2012 Moore ..... F41A 21/30 181/223
8,490,535 B1 * 7/2013 Moore ..... F41A 21/34 42/1.06

(Continued)

FOREIGN PATENT DOCUMENTS

DE 202019106316 U1 * 1/2020 ..... F41A 21/30

*Primary Examiner* — Troy Chambers
*Assistant Examiner* — Benjamin S Gomberg
(74) *Attorney, Agent, or Firm* — Rutan & Tucker LLP; Hani Z. Sayed

(57) ABSTRACT

An apparatus and methods are provided for a suppressor to be coupled with a muzzle end of a barrel of a firearm to reduce muzzle blast and muzzle flash. The suppressor comprises a housing having a proximal end and a distal end. A front portion within the housing comprises a series of cylindrical gas expansion chambers for attenuating the temperature and energy of propellant gases accompanying a projectile fired from the firearm. An annular gas expansion chamber surrounds the cylindrical gas expansion chambers and directs a portion of the propellant gases from a rear portion of the suppressor to peripheral vents disposed at the distal end. Lateral chambers within the rear portion deflect and rebound a portion of the propellant gases before passing them into the annular gas expansion chamber. Ledges within the annular gas expansion chamber direct the propellant gases distally through suppressor toward the peripheral vents.

16 Claims, 5 Drawing Sheets

(56) References Cited

U.S. PATENT DOCUMENTS 8,875,612 B1 * 11/2014 Klett ..... F41A 21/34 89/14.4
8,967,325 B1 * 3/2015 Cronhelm ..... F41A 21/30 89/14.4
9,500,427 B1 * 11/2016 Larue ..... F41A 21/30
10,234,231 B2 * 3/2019 Gianelloni, III ..... F41A 21/34
10,393,463 B1 * 8/2019 Sanders ..... F41A 21/34
10,890,403 B2 * 1/2021 Petersen ..... F42B 39/20
11,054,207 B2 * 7/2021 Martin ..... F41A 21/28
11,187,484 B2 * 11/2021 Hartwell ..... F41A 21/30
11,268,778 B2 * 3/2022 Wilson ..... F41A 21/30
11,668,540 B2 * 6/2023 Spector ..... F41A 21/30 89/14.4
11,668,541 B2 * 6/2023 Grob ..... F41A 21/30 89/14.4
11,674,417 B2 * 6/2023 Baxter ..... F41A 21/30 181/264
2011/0056111 A1 * 3/2011 Brittingham ..... F41A 21/30 29/557
2013/0180150 A1 * 7/2013 Dueck ..... F41A 21/34 29/428
2014/0020977 A1 * 1/2014 Shults ..... F41A 21/325 181/223
2014/0262605 A1 * 9/2014 Washburn, III ..... F41A 21/30 264/294
2017/0205175 A1 * 7/2017 Garst ..... F41A 21/30
2018/0252489 A1 * 9/2018 Parker ..... F41A 21/30
2020/0049442 A1 * 2/2020 Petersen ..... F41A 21/30
2020/0109907 A1 * 4/2020 Klett ..... F41A 21/30
2020/0224989 A1 * 7/2020 Bundy ..... F41A 21/325
2021/0003360 A1 * 1/2021 Kras ..... F41A 21/30
2021/0071979 A1 * 3/2021 Plunkett, Jr. ..... F41A 21/30
2023/0288162 A1 * 9/2023 Dueck ..... F41A 21/30 89/14.2

* cited by examiner

FIG. 2
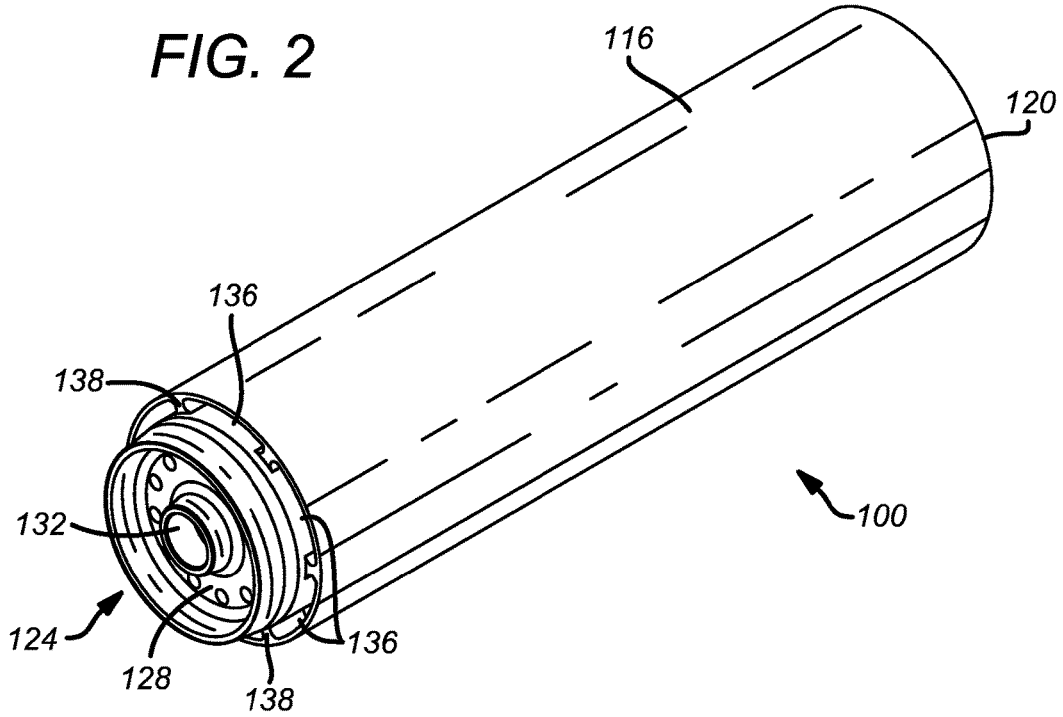
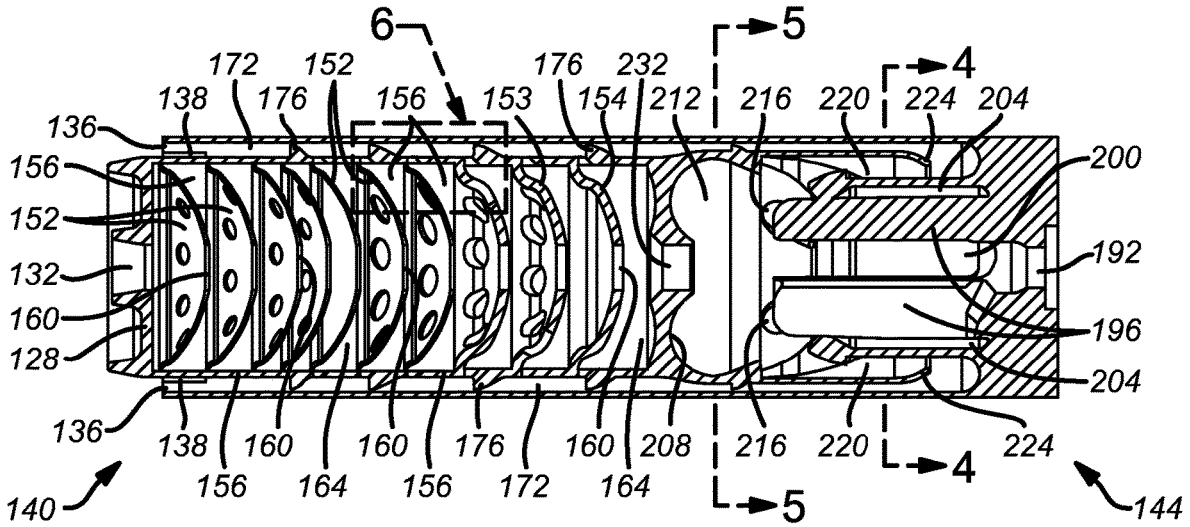
FIG. 3

FIG. 4
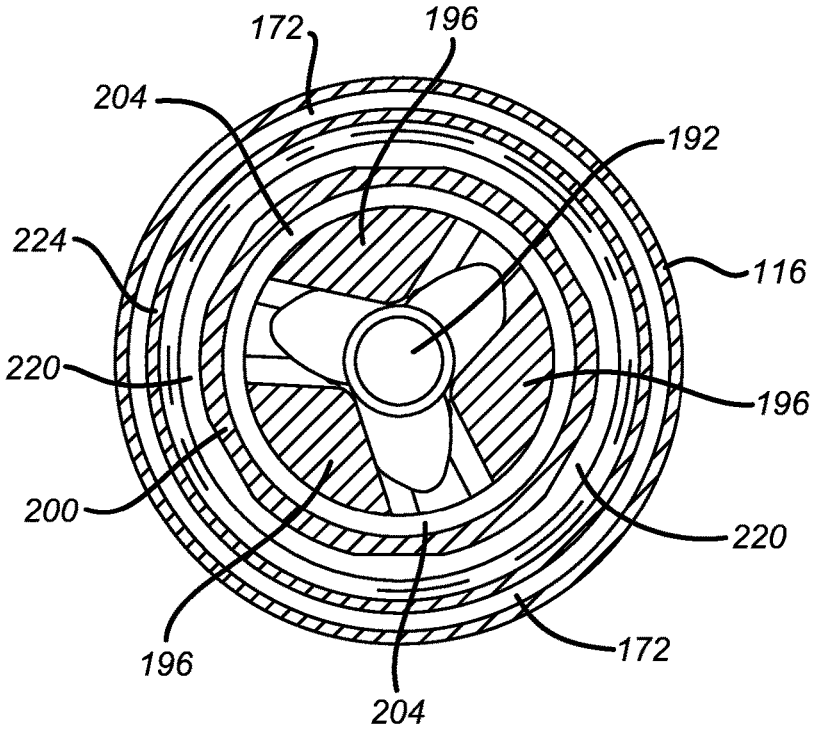
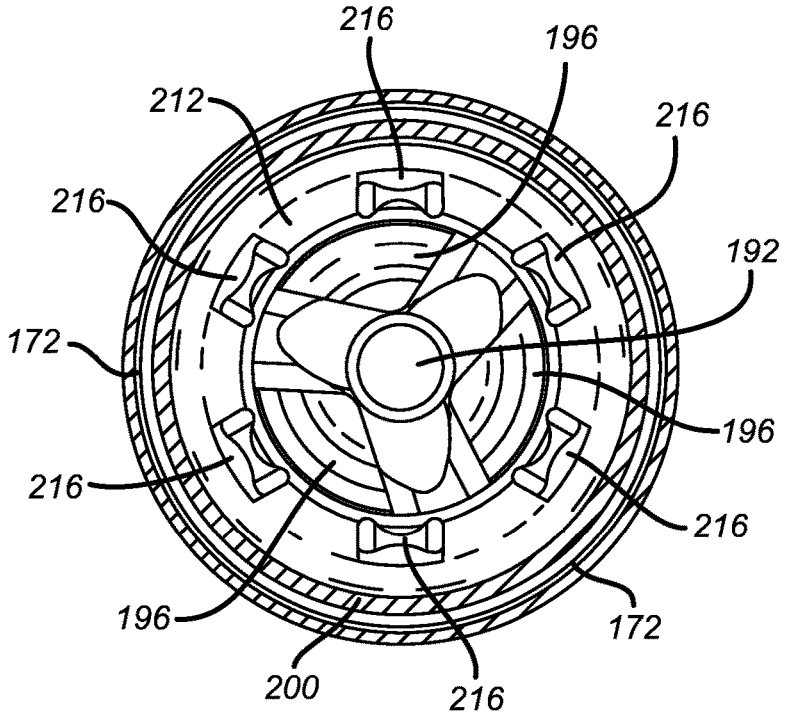
FIG. 5

FIREARM SOUND SUPPRESSOR WITH PERIPHERAL VENTING

PRIORITY

This application claims the benefit of and priority to U.S. Provisional Application, entitled "Firearm Sound Suppressor With Peripheral Venting," filed on Feb. 26, 2021, and having application Ser. No. 63/154,564, the entirety of said application being incorporated herein by reference.

FIELD

Embodiments of the present disclosure generally relate to firearms. More specifically, embodiments of the disclosure relate to an apparatus and methods for a noise and flash suppressor for firearms that exhibits a relatively low back pressure to reduce toxic fumes that may be inhaled during firing a weapon.

BACKGROUND

Firearms, such as pistols and rifles, generally utilize expanding high-pressure gases generated by a burning propellant to expel a projectile from the weapon at a relatively high velocity. When the projectile, or bullet, exits a muzzle end of the weapon's barrel, a bright, "muzzle flash" of light and a high-pressure pulse of combustion gases accompany the bullet. The rapid pressurization and subsequent depressurization caused by the high-pressure pulse gives rise to a loud sound known as "muzzle blast," which, like muzzle flash, can readily indicate to a remote enemy both the location of the weapon and the direction from which it is being fired. In some situations, such as covert military operations, it is highly desirable to conceal this information from the enemy by suppressing the muzzle flash and/or substantially reducing the amplitude of the muzzle blast.

The muzzle blasts of firearms may be reduced by using sound suppressors, such as "noise suppressors" and "silencers." Suppressors generally reduce muzzle blast by reducing and controlling the energy level of propellant gases accompanying a projectile as it exits the muzzle end of the weapon. Suppressors typically comprise an elongated tubular housing containing a series of baffles that define a plurality of successive internal chambers. The internal chambers control, delay, and divert the flow, expansion, and exit of the propellant gases. The internal chambers further serve to reduce the temperature of the propellant gases so as to cause a corresponding reduction in the noise produced by the propellant gases as they ultimately exit the suppressor. A rear portion of a typical suppressor may include a mechanism for removably attaching the suppressor to a firearm, and a front portion generally includes an opening for the exit of projectiles. Further, the front portion of suppressors typically are located sufficiently forward of the muzzle end of firearms to effectively reduce flash.

In some embodiments, suppressors are configured to reduce the temperature and pressure of propellant gases by introducing the gases into a succession of expansion chambers so as to give rise to a controlled expansion of the gases. In other embodiments, however, suppressors may be of a "multi-stage" variety that is configured to divert a portion of the propellant gases through a plurality of radial vents to one or more un-baffled, radially disposed "blast suppressor" chambers before being introduced into the succession of expansion chambers. Although multi-stage suppressors are relatively more complex to implement, they generally provide more opportunities to delay and cool the propellant gases, and hence, to reduce muzzle blast sound levels overall.

Existing suppressors have certain drawbacks that generally hinder their operation and/or efficiency. For example, one drawback to existing suppressors is that with extended use, particulate contaminates comprising propellant gases condense and are deposited on interior surfaces, such as the surfaces of the baffles, of the suppressors. These deposits include carbon from burnt propellant, lead from projectiles, and in the case of the use of "jacketed" projectiles, copper, Teflon, and/or molybdenum disulfide. While these deposits can usually be cleaned away with suitable solvents, they are typically hard and adhesive in nature, making it difficult or impossible to effectively clean the suppressor without damaging its parts.

Another drawback to existing multi-stage suppressors is that conventional sound and flash suppression generally causes higher back pressures within the suppressors. Higher back pressure is known to expose an operator of a weapon to toxic fumes arising due to firing the weapon. As such, a potential risk to the health of the operator grows in direct proportion to the amount of time spent using the weapon.

Another drawback to existing multi-stage suppressors is that the blast suppressor chambers generally experience substantially greater radial pressures and temperatures than the succession of baffled expansion chambers. The difference in pressure and temperature does not ordinarily present a problem during intermittent firing of a weapon, wherein sufficient time passes between rounds to allow the pressure and temperature within the suppressor to abate. During a relatively high rate of fire, such as sustained fully automatic fire, the difference in pressure and temperature may cause the outer tubular housing of the suppressor to fail prematurely. In some instances, the outer tubular housing may "blow out" due to sustained local pressures and temperatures during fully automatic firing of the weapon.

Still another problem with existing suppressors pertains to their ability to effectively suppress muzzle flash. Many existing suppressors are known to exhibit a relatively large muzzle flash when a first round is fired through the suppressor, such as when the weapon has not been recently fired. Immediately subsequent rounds, however, typically do not exhibit this relatively large muzzle flash.

Given the above-mentioned drawbacks to existing suppressors, there is a desire to develop a firearm sound suppressor that exhibits a relatively low back pressure, thereby reducing toxic fumes inhaled by a practitioner during firing a weapon, while effectively suppressing sound and flash due to firing the weapon.

SUMMARY

An apparatus and methods are provided for a suppressor to be coupled with a muzzle end of a barrel of a firearm to reduce muzzle blast and muzzle flash. The suppressor comprises a housing having a proximal end and a distal end. A front portion within the housing comprises a series of cylindrical gas expansion chambers for attenuating the temperature and energy of propellant gases. An annular gas expansion chamber surrounds the series of cylindrical gas expansion chambers and is configured to direct a portion of the propellant gases from a rear portion of the suppressor to peripheral vents disposed at the distal end. The rear portion comprises multiple lateral chambers for deflecting and rebounding a portion of the propellant gases before passing the propellant gases into the annular gas expansion chamber.

Circumferential apertures disposed between the cylindrical gas expansion chambers and the annular gas expansion chamber are configured to direct a portion of the propellant gases from the series of cylindrical gas expansion chambers into the annular gas expansion chamber. Ledges are disposed on an exterior of the series of cylindrical gas expansion chambers and configured to direct the propellant gases distally through the annular gas expansion chamber toward the peripheral vents. The annular gas expansion chamber comprises a continuous chamber that spans a portion of the length of the suppressor and opens to the peripheral vents.

In an exemplary embodiment, a suppressor for coupling with a muzzle end of a barrel of a firearm for reducing muzzle blast and eliminating muzzle flash comprises: a housing having a proximal end and a distal end; a front portion within the housing comprising a series of cylindrical gas expansion chambers for attenuating the temperature and energy of propellant gases; an annular gas expansion chamber surrounding the series of cylindrical gas expansion chambers for directing a portion of the propellant gases to peripheral vents disposed at the distal end; and a rear portion comprising multiple lateral chambers for deflecting and rebounding a portion of the propellant gases before entering the annular gas expansion chamber.

In another exemplary embodiment, the proximal end is adapted to couple the suppressor to the muzzle end by way of a suitable retaining mechanism or other suitable device. In another exemplary embodiment, the distal end comprises: a front plate; a central bore adapted to provide an exit to a projectile fired from the firearm; and the series of peripheral vents disposed between the front plate and the housing for releasing propellant gases.

In another exemplary embodiment, the front portion includes a series of baffles that are separated from one another by cylindrical spacers. In another exemplary embodiment, the cylindrical spacers are coaxially disposed within the front portion such that a central aperture comprising each of the baffles is coaxially aligned with a central bore comprising the distal end. In another exemplary embodiment, baffles near the rear portion include a blast baffle and are relatively thicker than other baffles within the front portion so as to withstand the pressure and temperature of propellant gases exiting the rear portion. In another exemplary embodiment, pairs of adjacent baffles and intervening cylindrical spacers generally define the cylindrical gas expansion chambers. In another exemplary embodiment, the series of cylindrical gas expansion chambers are configured to reduce the temperature of the propellant gases.

In another exemplary embodiment, one or more circumferential apertures are disposed between the cylindrical gas expansion chambers and the annular gas expansion chamber. In another exemplary embodiment, the one or more circumferential apertures are configured to direct the propellant gases from the cylindrical gas expansion chambers into the annular gas expansion chamber.

In another exemplary embodiment, the annular gas expansion chamber comprises a continuous chamber that spans a portion of the length of the suppressor and opens to the peripheral vents. In another exemplary embodiment, the portion of the length of the suppressor comprises a majority of the length of the suppressor. In another exemplary embodiment, one or more cylindrical spacers comprising the series of cylindrical gas expansion chambers include an exterior ledge configured for directing the propellant gases toward the peripheral vents. In another exemplary embodiment, the exterior ledge extends circumferentially around an exterior of a cylindrical spacer and includes a sloped surface and an acutely angled surface. In another exemplary embodiment, the exterior ledges are configured to keep the propellant gases flowing distally through the annular gas expansion chamber until exiting the peripheral vents. In another exemplary embodiment, the sloped surface is configured to offer little resistance to the propellant gases flowing in a distal direction while the acutely angled surface is configured to offer a relatively greater resistance to the propellant gases flowing in a proximal direction toward the rear portion.

In another exemplary embodiment, the rear portion comprises a firearm attachment that includes a central bore and three long tines that extend into a back end member. In another exemplary embodiment, a lateral gas expansion chamber is disposed between a portion of the long tines and the back end member and is adapted to divert and allow for expansion of a portion of the propellant gases entering the through the central bore. In another exemplary embodiment, curved interior surfaces of the back end member forward of the long tines define a primary gas expansion chamber. In another exemplary embodiment, the curved interior surfaces are adapted to deflect a portion of the propellant gases toward one or more vents disposed at a rear of the primary gas expansion chamber. In another exemplary embodiment, the one or more vents are configured to allow the portion of the deflected propellant gases to exit the primary gas expansion chamber and enter a blast suppression chamber. In another exemplary embodiment, the blast suppression chamber is disposed between a tapered blast deflector and a portion of the back end member that surrounds the lateral gas expansion chamber. In another exemplary embodiment, a rear portion of the blast suppression chamber exits into a rear-most portion of the annular gas expansion chamber such that the portion of the deflected propellant gases travel around the tapered blast deflector before entering the annular gas expansion chamber and exiting through the peripheral vents.

In an exemplary embodiment, a suppressor for a firearm comprises: a housing having a proximal end and a distal end; a front portion for attenuating the temperature and energy of propellant gases; an annular gas expansion chamber for directing a portion of the propellant gases to peripheral vents disposed at the distal end; and a rear portion for deflecting and rebounding a portion of the propellant gases before entering the annular gas expansion chamber.

In another exemplary embodiment, the front portion includes a series of cylindrical gas expansion chambers for attenuating the temperature and energy of the propellant gases; the annular gas expansion chamber surrounds the series of cylindrical gas expansion chambers; and the rear portion includes multiple lateral chambers for deflecting and rebounding the propellant gases. In another exemplary embodiment, the front portion includes a series of baffles that are separated from one another by cylindrical spacers. In another exemplary embodiment, pairs of adjacent baffles and intervening cylindrical spacers generally define cylindrical gas expansion chambers configured to reduce any of the temperature of the propellant gases, the pressure of the propellant gases, the velocity of the propellant gases, or any combination thereof. In another exemplary embodiment, one or more circumferential apertures are configured to direct propellant gases from the cylindrical gas expansion chambers into the annular gas expansion chamber. In another exemplary embodiment, the annular gas expansion chamber comprises a continuous chamber that extends from the rear portion to the peripheral vents.

In another exemplary embodiment, one or more ledges are disposed within the annular gas expansion chamber for directing propellant gases toward the peripheral vents. In another exemplary embodiment, the one or more ledges are disposed circumferentially around an interior of the annular gas expansion chamber and include a sloped surface and an acutely angled surface. In another exemplary embodiment, the one or more ledges are configured to keep the propellant gases flowing distally through the annular gas expansion chamber until exiting the peripheral vents.

In another exemplary embodiment, the rear portion comprises a firearm attachment that includes a central bore and three long tines that extend into a back end member. In another exemplary embodiment, a lateral gas expansion chamber is disposed between a portion of the long tines and the back end member and is adapted to divert and allow for expansion of a portion of propellant gases entering the through the central bore. In another exemplary embodiment, a primary gas expansion chamber comprises curved interior surfaces of the back end member forward of the long tines.

In another exemplary embodiment, the curved interior surfaces are adapted to deflect a portion of propellant gases toward one or more vents disposed at a rear of the primary gas expansion chamber. In another exemplary embodiment, the primary gas expansion chamber and the vents include one or more ledges for directing propellant gases toward a blast suppression chamber. In another exemplary embodiment, the ledges are disposed along a least a portion of a circumference of the primary gas expansion chamber and the vents.

In another exemplary embodiment, the blast suppression chamber is disposed between a tapered blast deflector and a portion of the back end member that surrounds the lateral gas expansion chamber. In another exemplary embodiment, a rear portion of the blast suppression chamber exits into a rear-most portion of the annular gas expansion chamber such that the portion of the deflected propellant gases travel around the tapered blast deflector before entering the annular gas expansion chamber. In another exemplary embodiment, the tapered blast deflector is configured to inhibit a backflow of propellant gases from the blast suppression chamber into the primary gas expansion chamber.

In an exemplary embodiment, a method for a suppressor for a firearm comprises: forming a housing having a proximal end and a distal end; arranging a front portion for attenuating the temperature and energy of propellant gases; disposing an annular gas expansion chamber around the front portion for directing a portion of the propellant gases to peripheral vents disposed at a distal end; and configuring a rear portion for deflecting and rebounding a portion of the propellant gases before entering the annular gas expansion chamber.

In another exemplary embodiment, disposing the annular gas expansion chamber includes surrounding the front portion with the housing such that the annular gas expansion chamber is disposed between an exterior of the front portion and an interior of the housing.

In another exemplary embodiment, the gas expansion chamber between an exterior of the front portion and an interior of the housing is semi-annular or consisting of a series of passages of some other cross-sectional shape directing a portion of the propellant gases to peripheral vents disposed at a distal end.

In another exemplary embodiment, the annular or otherwise shaped gas expansion chamber comprises more than one chamber in series to provide a path for directing a portion of the propellant gases to peripheral vents disposed at a distal end.

In another exemplary embodiment, the annular or otherwise shaped gas expansion chamber directs a portion of the propellant gases to a cylindrical gas expansion chamber that is in communication with the peripheral vents disposed at a distal end.

These and other features of the concepts provided herein may be better understood with reference to the drawings, description, and appended claims.

BRIEF DESCRIPTION OF THE DRAWINGS

The drawings refer to embodiments of the present disclosure in which:

FIG. 2 illustrates a perspective view of an exemplary embodiment of a suppressor that may be coupled to the muzzle end of a barrel of a firearm;

FIG. 3 illustrates a cross-sectional view of the suppressor shown in FIG. 2, taken a long a midline;

FIG. 4 illustrates a cross-sectional view of the suppressor shown in FIG. 3, taken along a line 4-4;

FIG. 5 illustrates a cross-sectional view of the suppressor shown in FIG. 3, taken along a line 5-5;

Figure 1:
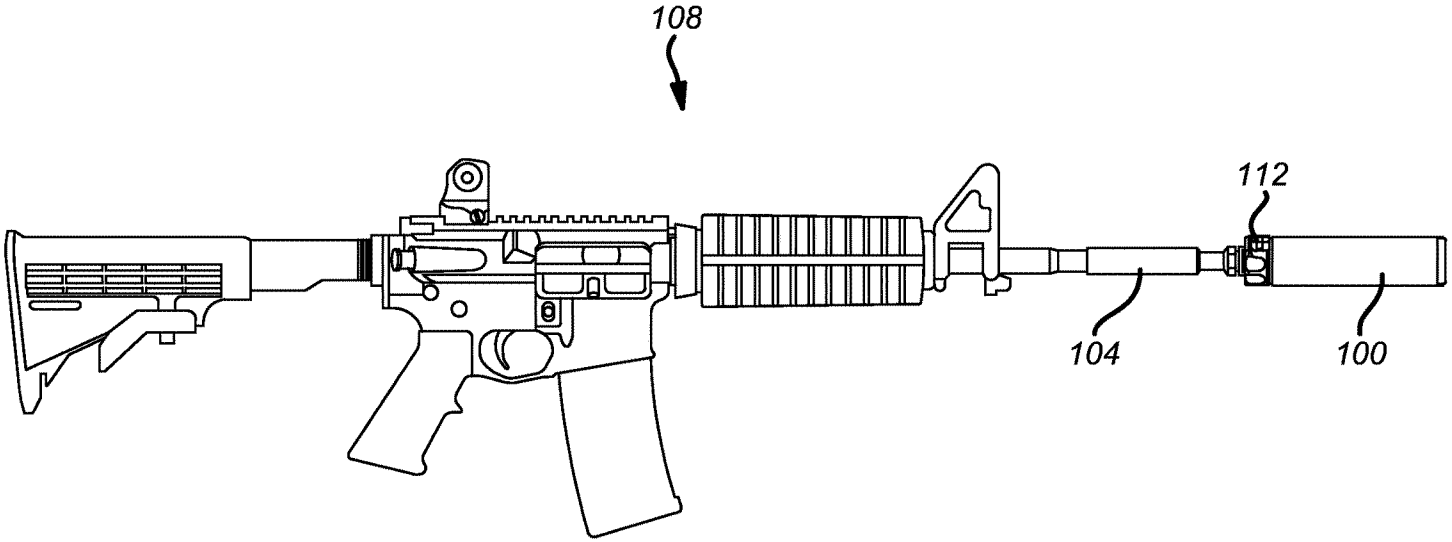
FIG. 1 illustrates a right-side elevation view of an exemplary embodiment of a suppressor coupled to a muzzle end of a barrel of a rifle in accordance with the present disclosure.

While the present disclosure is subject to various modifications and alternative forms, specific embodiments thereof have been shown by way of example in the drawings and will herein be described in detail. The present disclosure should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the suppressor for firearms and methods disclosed herein may be practiced without these specific details. In other instances, specific numeric references such as "first chamber," may be made. However, the specific numeric reference should not be interpreted as a literal sequential order but rather interpreted that the "first chamber" is different than a "second chamber." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, muzzle blasts of firearms may be reduced by using sound suppressors, such as "noise suppressors" and "silencers." Existing suppressors have certain drawbacks that generally hinder their operation and/or efficiency. One drawback to existing suppressors is that sustained pressure and temperature differentials arising during relatively high rates of fire a weapon may cause the suppressor to prematurely fail due to blowing out an exterior housing comprising the suppressor. Another drawback to existing suppressors is they may exhibit a relatively large muzzle flash when a first round is fired through the suppressor, such as when the weapon has not been recently fired. Another drawback to existing suppressors is their relatively high back pressures generally expose practitioners to toxic fumes that present potential health risks. Embodiments presented herein provide suppressors that exhibit relatively low back pressures, thereby reducing toxic fumes inhaled by practitioners, while effectively minimizing muzzle flash and muzzle blast.

FIG. 1 illustrates a right-side elevation view of an exemplary embodiment of a suppressor 100 coupled to the muzzle end of a barrel 104 of a firearm 108, such as a rifle, in accordance with the present disclosure. In the illustrated embodiment, the suppressor 100 is coupled with the barrel 104 by way of a retaining mechanism 112. For example, such a retaining mechanism may be implemented as described in U.S. Pat. Nos. 6,948,415, 7,676,976, 7,946,069, 8,091,462, and 8,459,406, all of which are incorporated by reference herein in their entirety. It is contemplated, however, that the suppressor 100 may be attached to the barrel 104 by way of any of various suitable devices and/or techniques.

FIG. 2 illustrates a perspective view of an exemplary embodiment of a suppressor 100 that may be coupled to the muzzle end of a barrel 104 of a firearm 108, as shown in FIG. 1. The suppressor 100 is a generally elongate member comprising a housing 116 and having a proximal end 120 and a distal end 124. As will be appreciated, the proximal end 120 is adapted to couple the suppressor 100 to the muzzle end of the barrel 104, such as by way of the above-mentioned retaining mechanism 112 or other suitable device. The distal end 124 comprises a front plate 128, a central bore 132, and a series of peripheral vents 136 disposed between the front plate 128 and the housing 116. In some embodiments, the peripheral vents 136 may be arranged to vent propellant gases in a distal direction or radially outward around the circumference of the housing 116, without limitation. The central bore 132 is adapted to provide an exit to a projectile, or a bullet, fired from the firearm 108 while the peripheral vents 136 are configured to provide an exit to expanding propellant gases accompanying the firing of the projectile. In some embodiments, the central bore 132 may be implemented with a tapered portion and an untapered portion, as described in detail in U.S. Pat. No. 8,505,680, which is incorporated herein by reference in its entirety.

In the embodiment of the suppressor 100 illustrated herein, the housing 116 is shown having a cylindrical shape, or being substantially tubular in nature. It should be understood, however, that the housing 116 is not limited to being cylindrical and/or tubular in shape or having a circular cross-sectional shape. For example, the housing 116 may have a cross-sectional shape comprising any of square, rectangular, oval, and the like, without limitation. Further, the housing 116 may comprise different shapes and sizes along the length of the housing 116. In some embodiments, for example, a first portion of the housing 116 may be tubular while a second portion of the housing 116 may having a non-tubular shape, such as a rectangular shape. Further, in some embodiments, the first portion of the housing 116 may comprise a tube having a first diameter while the second portion may comprise a tube having a second diameter that is larger or smaller than the first diameter. Other suitable configurations of the housing 116 will become apparent to those skilled in the art.

FIG. 3 illustrates a cross-sectional view of the suppressor 100 of FIG. 2, taken a long a midline. As will be appreciated, the suppressor 100 generally is of a "multi-stage" variety that is configured to divert a portion of propellant gases through a plurality of lateral blast suppression chambers before mixing the gases with a portion of propellant gases introduced into a succession of expansion chambers, as disclosed in greater detail herein. It is contemplated that, in some embodiments, the suppressor 100 may comprise a multiplicity of components that may be assembled, such as by way of laser welding as detailed in U.S. Pat. No. 10,088,259, which is incorporated herein by reference in its entirety. In some embodiments, however, the suppressor 100 may be monolithic in nature, and thus the suppressor 100 may be formed by way of 3D printing or other similar techniques, without limitation.

The interior of the suppressor 100 may be broadly separated into a front portion 140 and a rear portion 144. The front portion 140 comprises a series of baffles 152 that are separated from one another by cylindrical spacers 156 of various suitable sizes. The cylindrical spacers 156 are coaxially disposed within the front portion 140 such that a central aperture 160 comprising each of the baffles 152 is coaxially aligned with the central bore 132. Baffles 153 and 154 near the rear portion 144, including a blast baffle 208, are relatively thicker than other baffles 152 within the front portion 140 so as to withstand the pressure and temperature of propellant gases exiting the rear portion 144. As will be appreciated, each pair of adjacent baffles 152 and the intervening cylindrical spacer 156 generally defines a cylindrical gas expansion chamber 164. As such, the front portion 140 includes a longitudinally stacked series of cylindrical gas expansion chambers 164 that are configured to control, delay, and divert the flow, expansion, and exhausting of the propellant gases, as well as to reduce their temperature.

Figure 6:
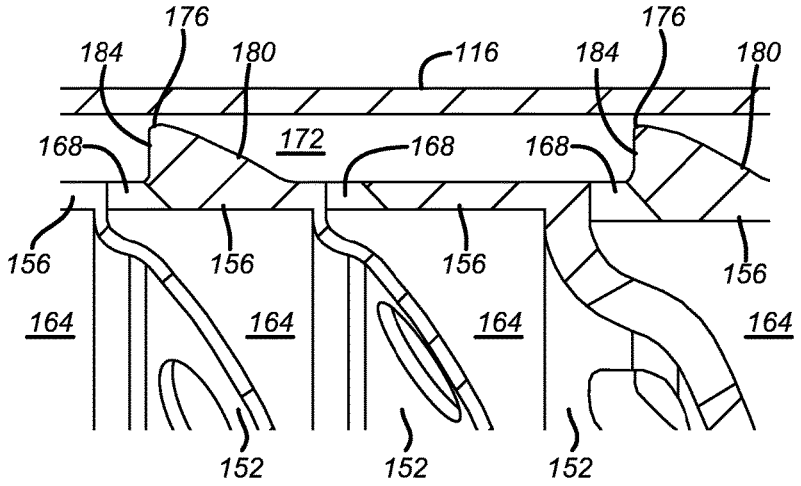
FIG. 6 illustrates a close-up view of baffles and circumferential apertures comprising the suppressor shown in FIG. 3.

As best shown in FIG. 6, one or more circumferential apertures 168 may be disposed between the cylindrical gas expansion chambers 164 and an annular gas expansion chamber 172 that is disposed between an outside surface of the spacers 156 and an inner surface of the housing 116. The circumferential apertures 168 may be formed in any of a front end, a rear end, or both the front and rear ends of the spacers 156, such that when an end of a spacer 156 is abutted against an opposing end of an adjacent baffle 152, a radial opening or vent is established between and the abutting ends. Additional details pertaining to the circumferential apertures 168 are provided in U.S. Pat. No. 10,088,259 which is incorporated herein by reference in its entirety.

The circumferential apertures 168 are configured to direct propellant gases in a radial direction from the cylindrical gas expansion chambers 164 into the annular gas expansion chamber 172 surrounding the spacers 152. As shown in FIG. 3, the annular gas expansion chamber 172 comprises a continuous chamber that spans a portion of the length of the suppressor 100 and opens to the peripheral vents 136. As such, the housing 116 is supported by mounts 138 disposed at the distal end 124 of the suppressor 100. As shown in FIGS. 3 and 6, one or more of the cylindrical spacers 156 may include an exterior ledge 176 configured to direct the propellant gases toward the peripheral vents 136. The exterior ledge 176 generally extends circumferentially around the exterior of the cylindrical spacer 156 and includes a sloped surface 180 and an acutely angled surface 184. The sloped surface 180 is configured to offer little resistance to propellant gases passing over the ledge 176 in a distal direction while the acutely angled surface 184 is configured to offer a relatively greater resistance to propellant gases flowing proximally toward the rear portion 144 of the suppressor 100. Thus, the exterior ledges 176 serve to keep the propellant gases flowing distally through the annular gas expansion chamber 172 until ultimately exiting the suppressor 100 through the peripheral vents 136.

It is contemplated that, in some embodiments, any one or more of the ledges 176 may be disposed on an inner surface of the housing 116, in lieu of extending along the exterior of the cylindrical spacers 156. As will be appreciated, ledges 176 disposed on the inner surface of the housing 116 may include a sloped surface and an acutely angled surface that are substantially similar to the surfaces 180, 184 described above. As such, the sloped and acutely angled surfaces comprising the ledges 176 disposed inside the housing 116 are configured to encourage the propellant gases flowing distally through the annular gas expansion chamber 172.

Turning, again, to FIG. 3, the rear portion 144 of the suppressor 100 comprises a firearm attachment 188 that includes a central bore 192 and three long tines 196 that extend into a back end member 200. As shown in FIG. 4, a lateral gas expansion chamber 204 is disposed between a portion of the long tines 196 and the back end member 200. The lateral gas expansion chamber 204 is adapted to divert a portion of the propellant gases entering the suppressor 100 through the central bore 192 and allow for expansion of the propellant gases.

As shown in FIG. 3, the back end member 200 includes curved interior surfaces 208 forward of the long tines 196 that define a primary gas expansion chamber 212. The curved interior surfaces 208 are adapted to deflect a portion of the propellant gases accompanying a fired bullet toward a rear of the primary gas expansion chamber 212. Multiple vents 216 at the rear of the chamber 212 allow a portion of the deflected propellant gases to exit the primary gas expansion chamber 212 and enter a blast suppression chamber 220. In an embodiment illustrated in FIG. 5, the primary gas expansion chamber 212 includes six vents 216. In other embodiments, however, any number of vents 216 may be disposed in the primary gas expansion chamber 212, without limitation.

As shown in FIGS. 3 and 4, the blast suppression chamber 220 is disposed between a tapered blast deflector 224 and a portion of the back end member 200 that surrounds the lateral gas expansion chamber 204. A rear portion of the blast suppression chamber 220 exits into a rear-most portion of the annular gas expansion chamber 172. Thus, the deflected propellant gases are caused to travel around the tapered blast deflector 224 before entering the annular gas expansion chamber 172 and exiting through the peripheral vents 136, as described herein.

Figure 7:
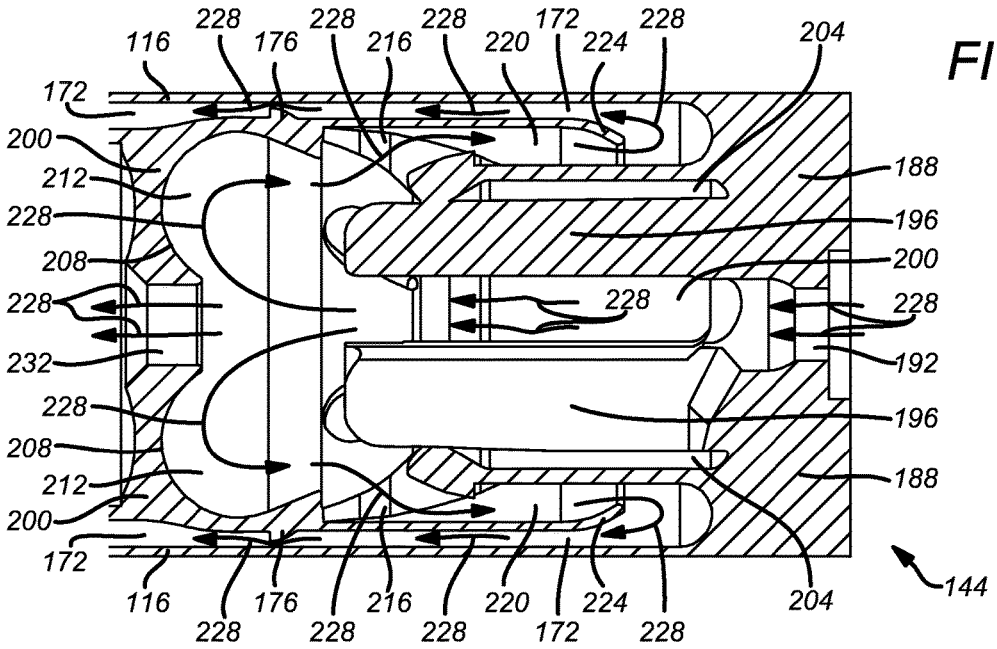
FIG. 7 illustrates an exemplary path followed by propellant gases traveling through the rear portion of the suppressor, according to the present disclosure.

FIG. 7 illustrates an exemplary path 228 followed by propellant gases traveling through the rear portion 144 of the suppressor 100, according to the present disclosure. As disclosure hereinabove, a portion of propellant gases accompanying a fired bullet is deflected rearward by the curved surfaces 208 of the primary gas expansion chamber 212. The deflected portion of propellant gases pass through the vents 216 and enter the blast suppression chamber 220. Upon passing around the tapered blast deflector 224, the deflected portion of propellant gases enter the annular gas expansion chamber 172 and are pushed distally into the forward portion 140 of the suppressor 100. As disclosed herein, the deflected portion of propellant gases may mix with propellant gases passing through the circumferential apertures 124 before exiting the suppressor 100 by way of the peripheral vents 136. It is contemplated that the rebounding of the propellant gases and their interaction among the chambers 204, 212, and 220 of the rear portion 144 continues with consequent energy attenuation, and with the propellant gases including the energy attenuated gases proceeding through a central aperture 232 and into the front portion 140 of the suppressor 100 to interact with the baffles 152 with resulting overall sound suppression efficiency.

Figure 8:
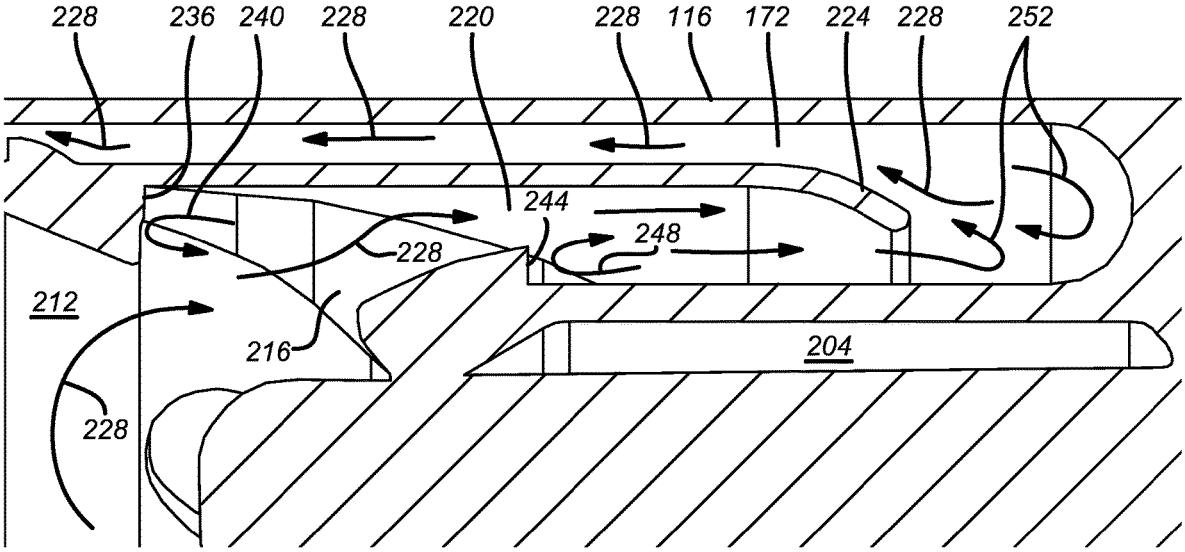
FIG. 8 illustrates an exemplary path followed by propellant gases traveling from a primary gas expansion chamber through a blast suppression chamber, around a tapered blast deflector, and into an annular gas expansion chamber.

FIG. 8 illustrates an exemplary path 228 followed by propellant gases traveling from the primary gas expansion chamber 212, through the blast suppression chamber 220, around the tapered blast deflector 224, and into the annular gas expansion chamber 172. As shown in FIG. 8, the primary gas expansion chamber 212 includes a ledge 236 that offers little resistance to propellant gases flowing into the blast suppression chamber 220 but relatively greater resistance to propellant gases flowing back into the primary gas expansion chamber 212. Consequently, the ledge 236 deflects any back-flowing gases 240 toward the blast suppression chamber 220. Similarly, the blast suppression chamber 220 includes a ledge 244 that deflects any back-flowing gases 248 toward the tapered blast deflector 224. Further, the tapered blast deflector 224 serves to direct any back-flowing gases 252 into the annular gas expansion chamber 172. As will be appreciated, therefore, the ledges 236, 244 and the tapered blast deflector 224 serve to keep the propellant gases flowing into the annular gas expansion chamber 172 before ultimately exiting the suppressor 100 through the peripheral vents 136, as described herein.

While the suppressor and methods have been described in terms of particular variations and illustrative figures, those of ordinary skill in the art will recognize that the suppressor is not limited to the variations or figures described. In addition, where methods and steps described above indicate certain events occurring in certain order, those of ordinary skill in the art will recognize that the ordering of certain steps may be modified and that such modifications are in accordance with the variations of the suppressor. Additionally, certain of the steps may be performed concurrently in a parallel process when possible, as well as performed sequentially as described above. To the extent there are variations of the suppressor, which are within the spirit of the disclosure or equivalent to the suppressor found in the claims, it is the intent that this patent will cover those variations as well. Therefore, the present disclosure is to be understood as not limited by the specific embodiments described herein, but only by scope of the appended claims.

What is claimed is:

1. A suppressor for a firearm, comprising:

a housing having a proximal end and a distal end;

a front portion for attenuating temperature and energy of propellant gases and comprising a series of baffles;

an annular gas expansion chamber disposed between an outside surface of a plurality of spacers and an inner surface of the housing, the annular gas expansion chamber comprising a continuous chamber surrounding a series of cylindrical gas expansion chambers and extending along a portion of the suppressor's length, and configured for directing a portion of the propellant gases distally to peripheral vents disposed at the distal end;

a plurality of circumferential apertures disposed radially between each of the cylindrical gas expansion chambers and the annular gas expansion chamber; and a rear portion comprising a back end member defining a lateral gas expansion chamber and a primary gas expansion chamber for deflecting and rebounding a portion of the propellant gases before entering the annular gas expansion chamber;

wherein the back end member comprises at least one curved interior surface adapted to deflect a portion of the propellant gases toward one or more vents disposed at a rear of the primary gas expansion chamber;

wherein the at least one curved interior surface is configured to withstand pressure and temperature of the propellant gases;

wherein the suppressor is configured to divert a first portion of the propellant gases deflected by the at least one curved interior surface through the annular gas expansion chamber prior to mixing the first portion of the propellant gases with a second portion of the propellant gases introduced through the plurality of circumferential apertures into the annular gas expansion chamber;

wherein the primary gas expansion chamber and the one or more vents include one or more ledges for directing the propellant gases toward a blast suppression chamber; and wherein the blast suppression chamber is disposed between a tapered blast deflector and a portion of the at least one curved interior surface, such that the blast suppression chamber surrounds the lateral gas expansion chamber.

2. The suppressor of claim 1, wherein the series of cylindrical gas expansion chambers are configured for attenuating the temperature and energy of the propellant gases; wherein the annular gas expansion chamber surrounds the series of cylindrical gas expansion chambers; and wherein the rear portion includes the at least one curved interior surface for deflecting and rebounding the propellant gases.

3. The suppressor of claim 2, wherein the plurality of spacers is adapted to separate the series of baffles from one another.

4. The suppressor of claim 3, wherein pairs of adjacent baffles in the series of baffles each define one of the series of cylindrical gas expansion chambers to reduce the temperature of the propellant gases, the pressure of the propellant gases, a velocity of the propellant gases, or any combination thereof.

5. The suppressor of claim 4, wherein the plurality of circumferential apertures is configured to direct the propellant gases from one or more of the series of cylindrical gas expansion chambers into the annular gas expansion chamber.

6. The suppressor of claim 1, wherein the continuous chamber of the annular gas expansion chamber comprises a multitude of continuous chambers.

7. The suppressor of claim 1, wherein the continuous chamber of the annular gas expansion chamber comprises a series of chambers.

8. The suppressor of claim 1, wherein the annular gas expansion chamber extends continuously from the rear portion to the peripheral vents.

9. The suppressor of claim 1, wherein one or more ledges are disposed within the annular gas expansion chamber for directing the propellant gases toward the peripheral vents.

10. The suppressor of claim 9, wherein the one or more ledges are disposed circumferentially around an interior of the annular gas expansion chamber and include a sloped surface and an acutely angled surface.

11. The suppressor of claim 9, wherein the one or more ledges are configured to keep the propellant gases flowing distally through the annular gas expansion chamber until exiting the peripheral vents.

12. The suppressor of claim 1, wherein the lateral gas expansion chamber is disposed between a portion of tines of a firearm attachment and the at least one curved interior surface and is adapted to divert and allow for expansion of a portion of the propellant gases entering through a central bore of the firearm attachment.

13. The suppressor of claim 1, wherein the one or more ledges are disposed along at least a portion of a circumference of the primary gas expansion chamber and the one or more vents.

14. The suppressor of claim 1, wherein a rear portion of the blast suppression chamber exits into a rear-most portion of the annular gas expansion chamber such that the propellant gases travel around the tapered blast deflector before entering the annular gas expansion chamber.

15. The suppressor of claim 14, wherein the tapered blast deflector is configured to inhibit back-flow of the propellant gases from the blast suppression chamber into the primary gas expansion chamber.

16. A method for making a suppressor for a firearm, comprising:

forming a housing having a proximal end and a distal end;

arranging a front portion for attenuating temperature and energy of propellant gases, wherein the front portion comprises a series of baffles;

disposing an annular gas expansion chamber between an outside surface of a plurality of spacers and an inner surface of the housing, the annular gas expansion chamber comprising a continuous chamber surrounding a series of cylindrical gas expansion chambers and extending along a portion of the suppressor's length, and configured for directing a portion of the propellant gases to peripheral vents disposed at the distal end;

providing a plurality of circumferential apertures disposed radially between the cylindrical gas expansion chambers and the annular gas expansion chamber;

configuring a rear portion comprising a back end member defining a lateral gas expansion chamber and a primary gas expansion chamber for deflecting and rebounding a portion of the propellant gases before entering the annular gas expansion chamber, the back end member comprising at least one curved interior surface adapted to deflect the portion of the propellant gases toward one or more vents disposed at a rear of the primary gas expansion chamber, the at least one curved interior surface configured for withstanding pressure and temperature of the propellant gases, the primary gas expansion chamber and the one or more vents including one or more ledges for directing the propellant gases toward a blast suppression chamber;

disposing the blast suppression chamber between a tapered blast deflector and a portion of the at least one curved interior surface, such that the blast suppression chamber surrounds the lateral gas expansion chamber; and diverting, by deflecting off of the at least one curved interior surface, a first portion of the propellant gases through the annular gas expansion chamber prior to mixing the first portion of the propellant gases with a second portion of the propellant gases introduced through the plurality of circumferential apertures into the annular gas expansion chamber.

* * * * *